United States Patent [19]

Fishburn

[11] 4,003,526

[45] Jan. 18, 1977

[54] DISPENSER FOR ROLLS OF FLEXIBLE SHEET MATERIAL

[76] Inventor: Clarence H. Fishburn, 1642 Woodcrest Drive, Wooster, Ohio 44691

[22] Filed: Nov. 24, 1975

[21] Appl. No.: 634,639

[52] U.S. Cl. ..... 242/55.3; 312/39

[51] Int. Cl.[2] ..... A47K 10/22

[58] Field of Search ..... 312/38, 39; 242/55.3, 242/55.53

[56] References Cited

UNITED STATES PATENTS

| | | | |
|---|---|---|---|
| 2,751,162 | 6/1956 | Bolger | 242/55.53 |
| 3,101,181 | 8/1963 | Clelland et al. | 242/55.53 |
| 3,387,902 | 6/1968 | Perrin et al. | 242/55.53 |
| 3,584,802 | 6/1971 | Sieber | 242/55.3 |
| 3,771,739 | 11/1973 | Nelson | 242/55.3 |

*Primary Examiner*—Casmir A. Nunberg
*Attorney, Agent, or Firm*—Mack D. Cook, II

[57] ABSTRACT

A dispenser for multiple rolls of flexible sheet material. The dispenser housing has a storage chamber and a dispensing chamber interconnected by a roll handling mechanism. The roll handling mechanism comprises opposed projecting and retractable lugs carried by longitudinal tracks within the housing and slidable between the chambers. The lugs are actuated to retract during movement toward the storage chamber and to project during movement toward the dispensing chamber.

4 Claims, 10 Drawing Figures

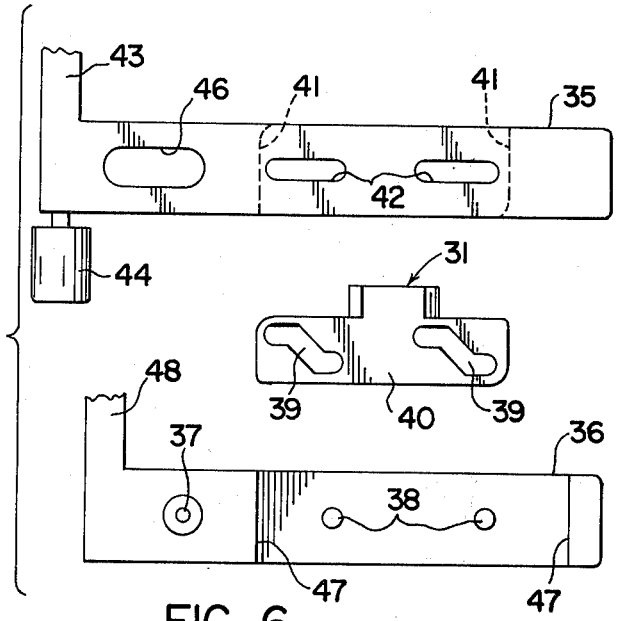
FIG. 6
FIG. 7
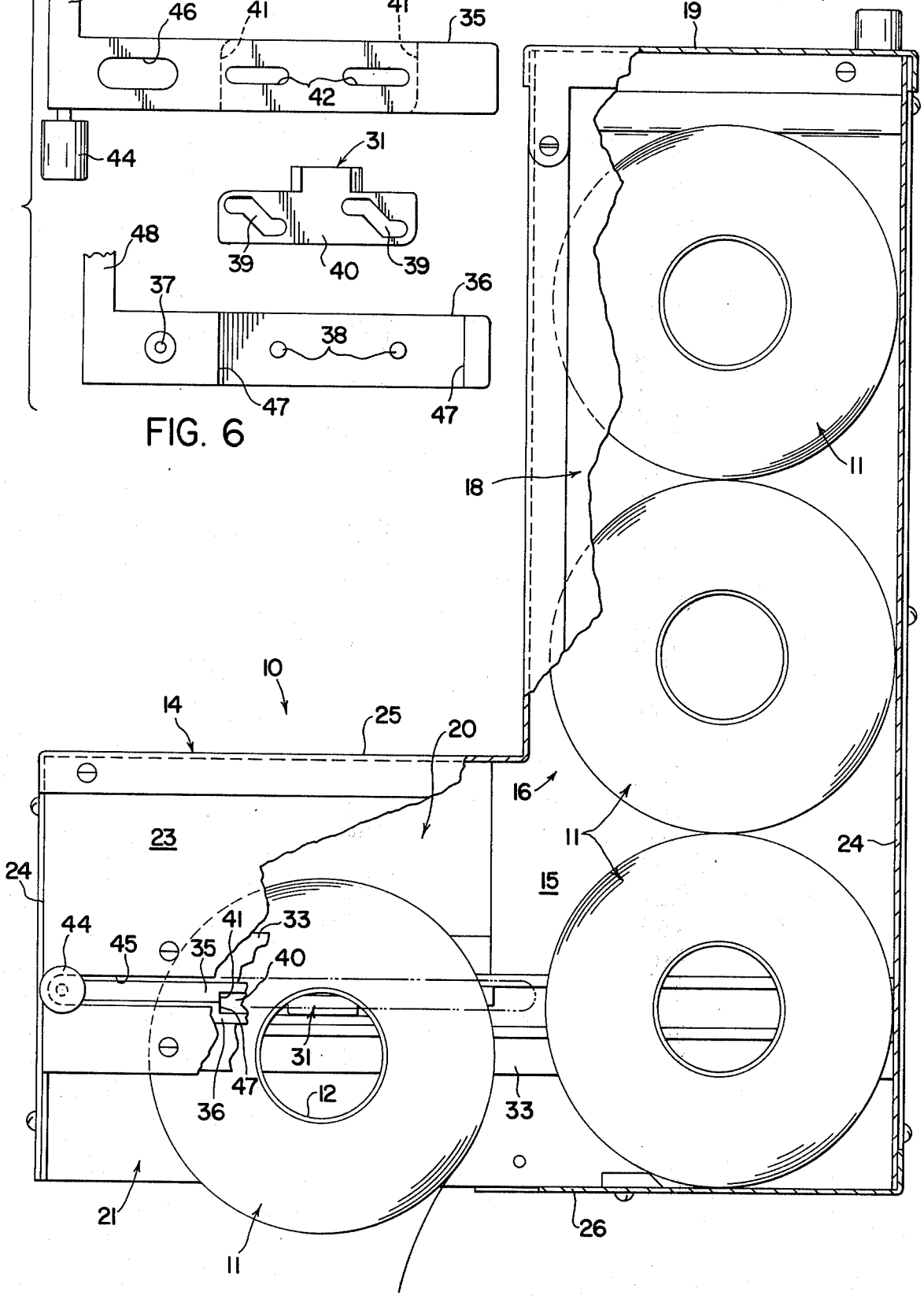

DISPENSER FOR ROLLS OF FLEXIBLE SHEET MATERIAL

BACKGROUND OF THE INVENTION

The invention relates to dispensers for multiple rolls of flexible sheet material. The material rolls may be toilet tissue, paper towel, aluminum foil, plastic wrapping, or the like; staple items used every day.

Material roll dispensers are, of course, not new. A nail or peg on the wall is a primitive form of dispenser. As the standard of living has advanced, many forms, shapes, and styles of tissue dispensers have evolved. Some have been concerned with efficiency of use. Some have been concerned with aesthetics. Still others have provided for multiple roll capacity, with or without anti-pilfering capabilities. While there, many persons have had many ideas for improvements to an accessory for a better life style.

It has been found that the subject matter of the invention is efficient for use, may be aesthetically mounted or effectively concealed within cabinetry or wall space, will have multiple roll capacity, and may be provided with anti-pilfering capabilities. Further, an apparatus according to the invention may be constructed of corrosion-resistant materials. While perhaps somewhat more expensive to fabricate than other forms of tissue dispensers, the longer useful life and other improved features of the apparatus of the invention outweigh any cost disadvantage.

The prior patent art has been reviewed and U.S. Pat. No. 2,751,162, June 1956, Bolger, U.S. Pat. No. 2,794,604, June 1957, Jacomaro, U.S. Pat. No. 3,101,181, August 1963, Clelland, et al, U.S. Pat. No. 3,437,388, April 1969, Jespersen, and U.S. Pat. No. 3,584,802, June 1971, Sieber, have been selected as the most pertinent prior art. It has also been determined that the search field includes Class 242, including sub-classes 55.3 and 55.53 and Class 312, including sub-class 39.

SUMMARY OF THE INVENTION

It is an object of the invention to provide an improved dispenser for multiple rolls of flexible sheet material.

It is a further object of the invention to provide a material roll dispenser with multiple roll capacity which is efficient for use, which may be effectively concealed within cabinetry or wall space, and which may be provided with anti-pilfering capabilities.

These and other objects of the invention, and the advantages thereof, will be apparent in view of the description of a preferred embodiment, as set forth below.

In general, a dispenser according to the invention has a housing with a storage chamber and a dispensing chamber interconnected by a roll handling mechanism. The roll handling mechanism comprises opposed projecting and retractable lugs carried by longitudinal tracks within the housing and slidable between the chambers. The lugs are actuated to retract during movement toward the storage chamber and to project during movement toward the dispensing chamber.

DESCRIPTION OF THE DRAWINGS

FIG. 6 is an exploded view showing further details of the roll handling mechanism; and FIG. 7 is a side view of an alternative form of the dispenser.

DETAILED DESCRIPTION OF THE INVENTION

A dispenser according to the invention is referred to generally by the numeral 10. The dispenser 10 contains multiple rolls 11 of flexible sheet material. As shown, the rolls 11 are toilet tissue with a core defined by a tube 12. A dispenser 10 could also be adapted to contain rolls of paper towel, aluminum foil, plastic wrapping, or the like.

Figure 1:
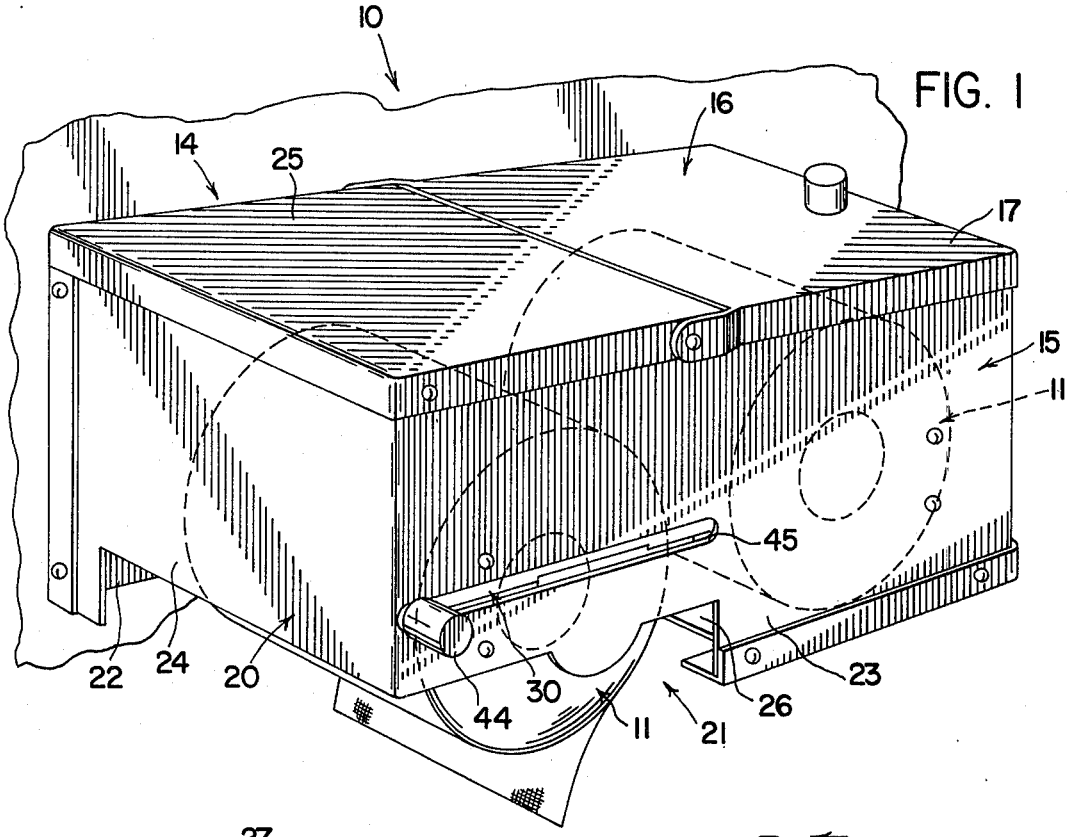
FIG. 1 is a perspective view of a dispenser for rolls of flexible sheet material according to the invention, as adapted for wall mounting.
Figure 2:
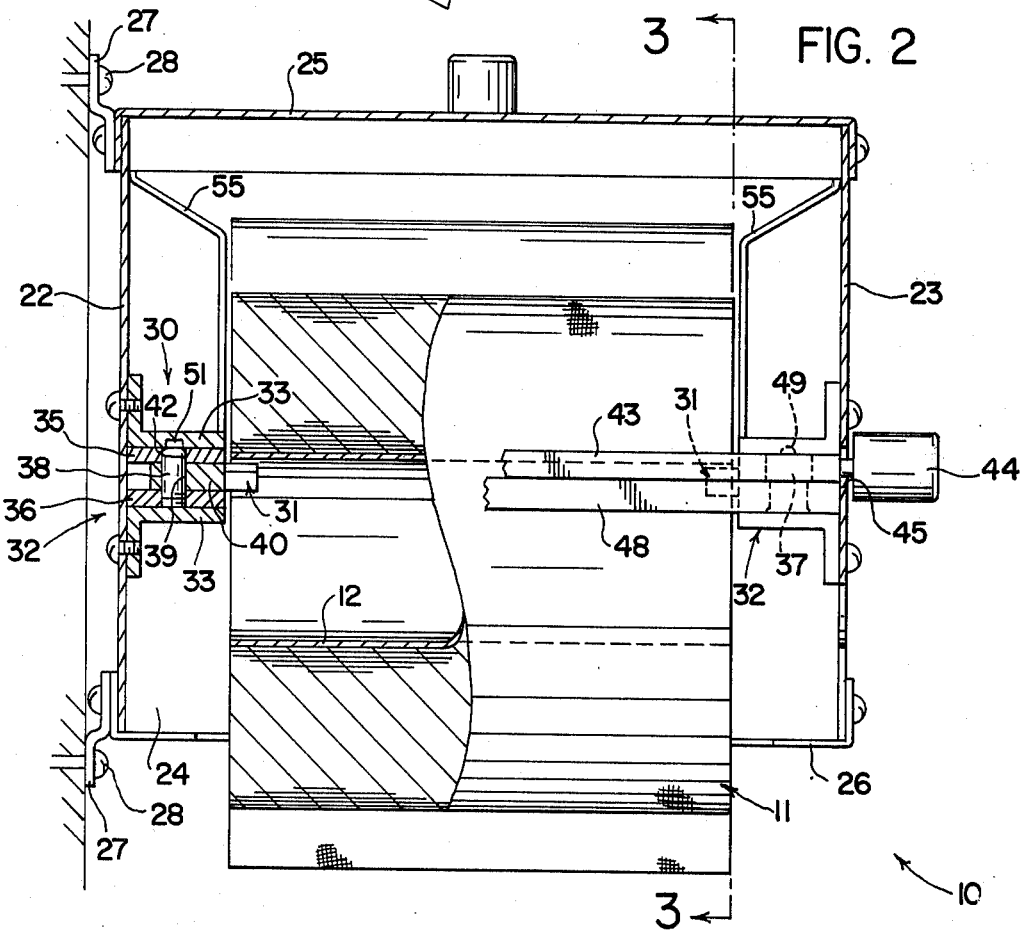
FIG. 2 is an end view of the dispenser of FIG. 1.
Figure 3:
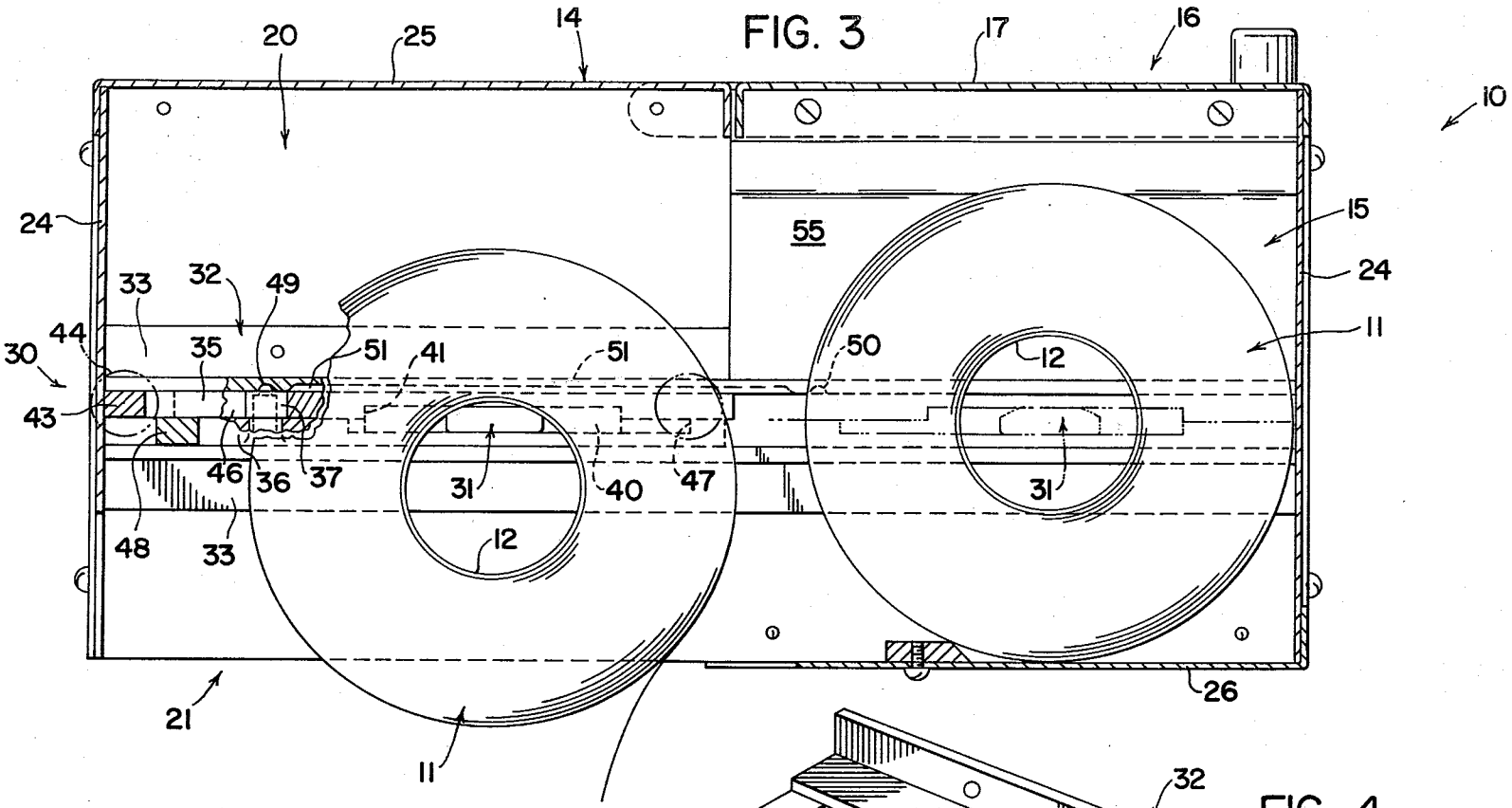
FIG. 3 is a side view, taken substantially as indicated on line 3—3 of FIG. 2.

The dispenser 10 has a housing indicated generally at 14. The dispenser housing 14 encloses a roll storage chamber indicated generally at 15. The storage chamber 15 has a roll supply opening indicated generally at 16. As shown in FIGS. 1–3, the roll supply opening 16 is closed as by a suitably hinged door 17. As shown in FIG. 7, the roll supply opening 16 communicates with a multiple roll storage chamber indicated generally at 18 and is closed as by a suitably hinged door 19.

The dispenser housing 14 also encloses a roll dispensing chamber indicated generally at 20. The dispensing chamber 20 has a roll access opening indicated generally at 21.

The dispenser housing 14 is formed by rear and front side walls 22 and 23, end walls 24, a top wall 25, and a bottom wall 26. The dispenser embodiment of FIGS. 1–3 has been adapted for wall mounting as by brackets 27 and suitable fastening means 28. The dispenser embodiment of FIG. 7 may be similarly wall mounted or suitably recessed within cabinetry or wall space and providing access to the door 19 and the opening 21.

The storage chamber 15 and dispensing chamber 20 are interconnected by a roll handling mechanism referred to generally by the numeral 30. The roll handling mechanism 30 extends between, and is preferably attached to or carried by, the housing side walls 22 and 23.

Figure 4:
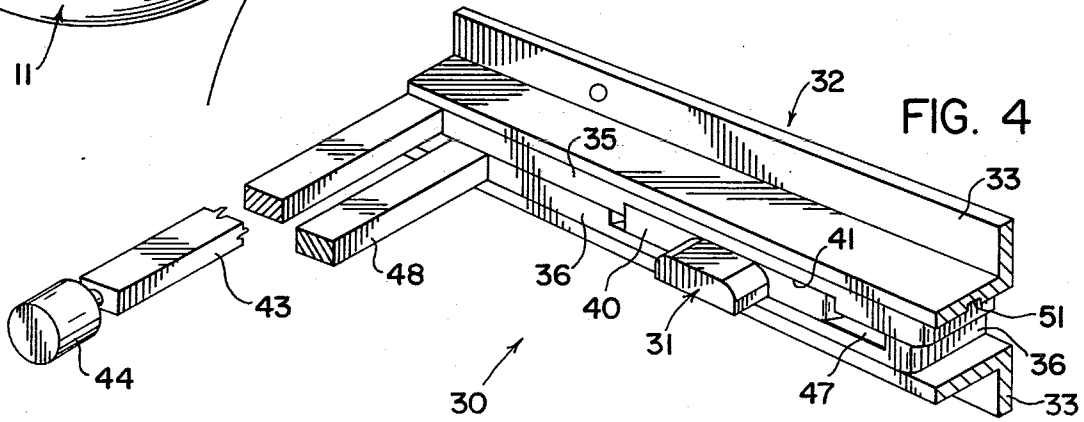
FIG. 4 is a fragmentary view showing details of the dispenser roll handling mechanism.

The roll handling mechanism 30 has dual opposed projecting and retractable lugs indicated generally at 31. The lugs 31 are carried by and slidable within dual longitudinal tracks indicated generally at 32. The tracks 32 are attached to the rear and front side walls 22 and 23, and positioned so that the lugs 31 will be generally aligned with the axis of the core 12 of a roll 11 in the storage chamber 15. As best shown in FIGS. 2, 3, and 4, each track 32 may be formed by dual spaced apart L-shaped rails 33.

Referring also to FIG. 6, the lugs 31 are projected or retracted during movements within the tracks 32 away from or toward the storage chamber 15 by the coaction of upper and lower actuator elements 35 and 36 with detent elements 37 and dual drive pins 38 confined within dual angular slots 39 defining inclined cam surfaces in a base element 40 carrying each laterally directed lug 31.

Each opposed upper actuator element 35 of a roll handling mechanism 30 is an elongated component having a width conforming substantially to the width of a track rail 33. The medial portion of each actuator element 35 has a transverse notch 41 to captivate the lug base element 40 and permit a "lost motion" or laterally translational projection or retraction movement of a lug 31, as described in further detail below. Above each notch 41, the actuator element 35 has elongate slots 42 for receiving and guiding dual drive pins 38. The length of the slots 42 is such so as to permit a "relative motion" or longitudinally translational movement of the actuator elements 35 and 36, as described in further detail below.

The opposed upper actuator elements 35 are coupled together for unitary movement by a cross bar 43. The end of the cross bar 43, adjacent the outer housing wall 23, carries an actuating knob 44. The actuating knob 44 is movable longitudinally within a slot 45 in the front wall 23 to actuate the roll handling mechanism 30. Between a notch 41 and the cross bar 43, each upper actuator element 35 has another elongate slot 46 receiving the detent element 37. The length of the slot 46 is chosen relative to the length of the dual slots 42 so as to accomodate the "relative motion" of the actuator elements 35 and 36.

Each lower actuator element 36 of a roll handling mechanism 30 is an elongated component having a width conforming substantially to the width of a track rail 33. The medial portion of each actuator element 36 has a transverse notch 47 to receive the lug base element 40. The length of a notch 47 is such so as to permit a "relative motion" or longitudinally translational movement of a lug 31 during movement of the actuator elements 35 and 36, as described in detail below. The floor of each notch 47 carries the dual drive pins 38.

The opposed lower actuator elements 36 are coupled together for unitary movement by a cross bar 48. A conventional detent mechanism 37 is mounted on each lower actuator element 36 between a notch 47 and the cross bar 48 and projects through a slot 46 in an upper actuator element. As described in detail next below, at stages during operation of the roll handling mechanism 30 the detent mechanism 37 is momentarily engaged within an outer detent hole 49, or an inner detent hole 50, in the lower face of the upper track rail 33. The detent holes 49 and 50 are shown in FIG. 3, and a passage groove 51 is preferably provided to reduce the friction load of the detent mechanism 37 during movement of the roll handling mechanism 30 between the chambers 15 and 20.

Figure 5:
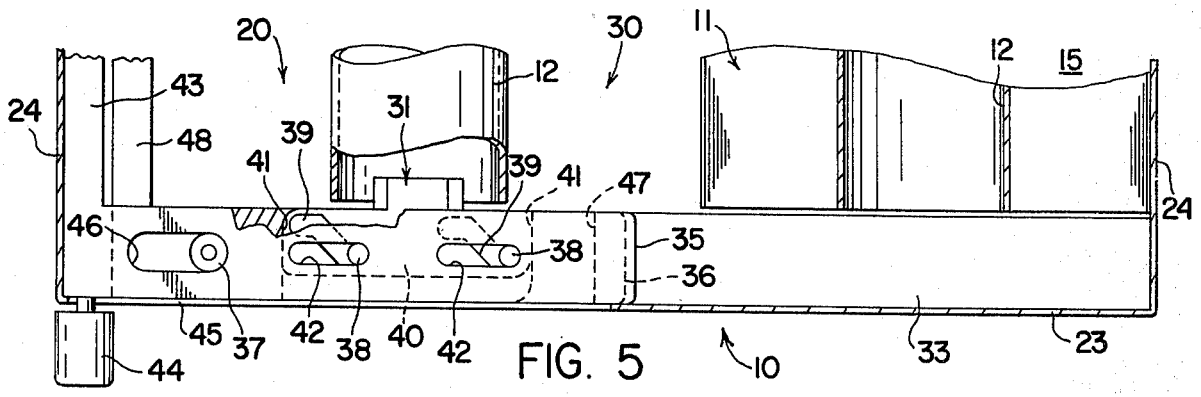
FIGS. 5, 5A, 5B, and 5C are fragmentary bottom views showing sequential movements of the roll handling mechanism.
Figure 5A:
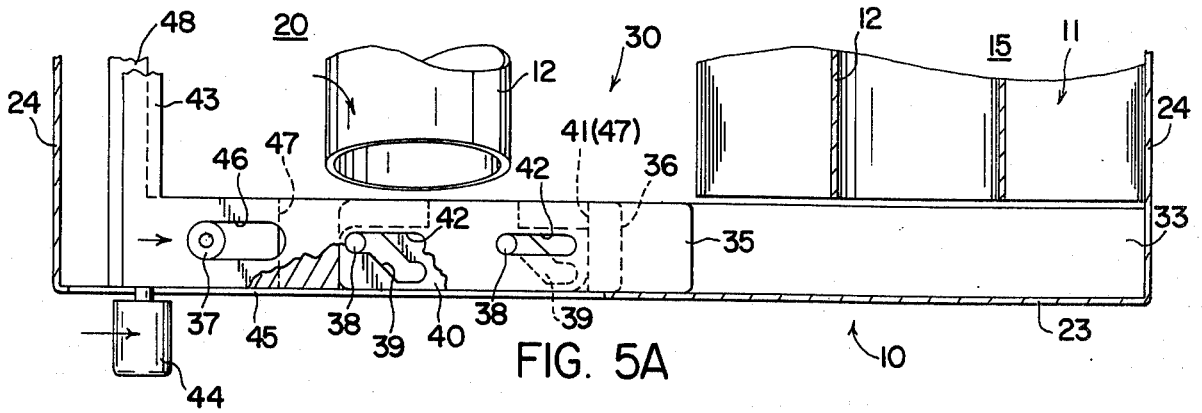
Figure 5B:
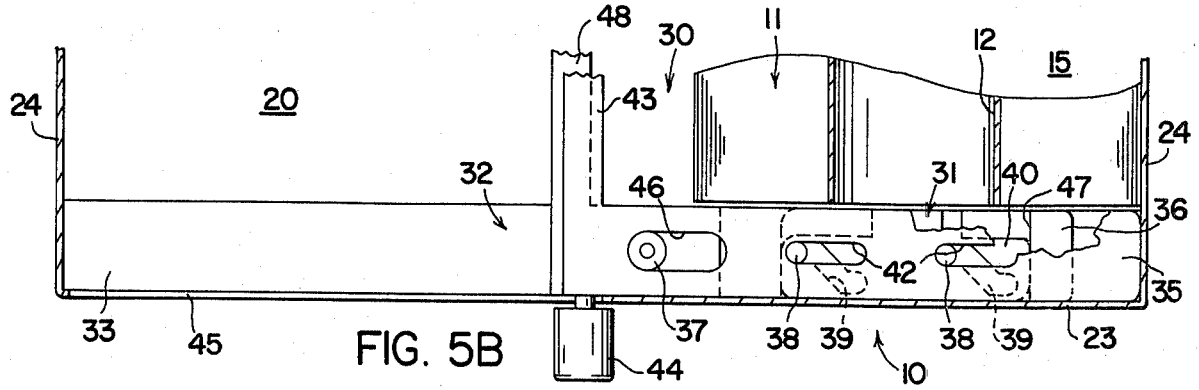
Figure 5C:
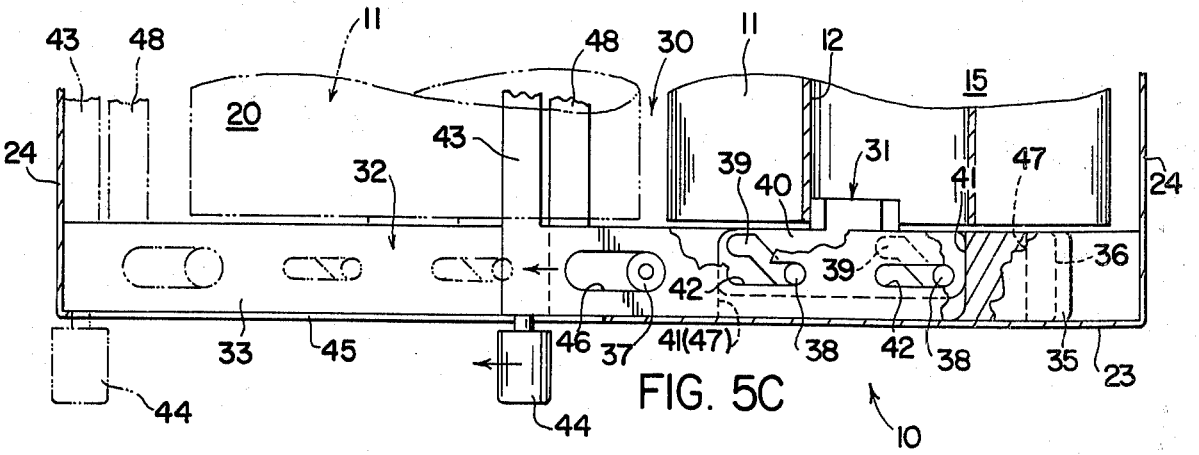

The operational sequences of a dispenser 10 having a roll handling mechanism 30 may be further understood by reference to FIGS. 5–5C.

FIG. 5 shows the roll handling mechanism 30 and the extended lugs 31 positioning and supporting a core 12 in the dispensing chamber 20. The upper actuator element 35 is adjacent an end wall 24. The detent element 37 is at the inner end of the elongate slot 46 and engaged within the track rail detent hole 49 (see FIG. 3). The dual pins 38 are at the inner ends of the angular slots 39 and the elongate slots 42. The lug base 40 is against the outer end of the lower actuator element notch 47. In this condition, sheets of flexible material from the roll 11 may be selectively used and dispensed until depleted.

FIG. 5A shows the beginning of the operation to replace the depleted core 12 with a full roll 11 in storage chamber 15. The actuating knob 44 is moved toward the storage chamber 15. The upper actuator element 35 has moved relative to the lower actuator element 36 which has been restrained by the detent element 37. The detent element 37 is at the outer end of the elongate slot 46 and engaged within the track detent hole 49. The dual pins 38 are at the outer ends of the angular slots 39 and the elongate slots 42. The lug bases 40 are against the inner end of the lower actuator element notches 47. The lugs 31 have retracted and the depleted core 12 will drop free through the access opening 21.

FIG. 5B shows the roll handling mechanism 30 in position for pick up and movement of a full roll 11 from the storage chamber. The upper and lower actuating elements 35 and 36 have moved together. The detent element 37 is at the outer end of the elongate slot 46 and engaged with the track detent hole 50 (see FIG. 3). The dual pins 38 remain at the outer ends of the angular slots 39 and the elongate slots 42. The lug bases 40 are against the inner ends of the lower actuator element notches 47. The lugs 31 are generally aligned with the axis of the core 12 of a roll 11.

FIG. 5C shows the operation of moving a full roll 11 toward the dispensing chamber 20. The actuating knob 44 is moved away from the storage chamber 15. The upper actuator element 35 has again moved relative to the lower actuator element 36, which has been restrained by the detent element 37. The detent element 37 is again at the inner end of the elongate slot 46. The dual pins 38 are again at the inner ends of the angular slots 39 and the elongate slots 42. The lugs 31 have extended to engage and support a roll 11 in the storage chamber 15. Continued movement of the actuating knob 44 toward the dispensing chamber 20 will reach the condition shown in chain lines, which is the full line position of FIG. 5.

Embodiments of a dispenser 10 for multiple rolls 11 of flexible sheet material have been shown and described. Changes and modifications in and to the dispenser 10 could be made. For example, the storage chamber 15 may be provided with side baffles 55 adjacent the supply opening 16 to facilitate loading of full rolls 11. Or, the actuating knob 44 could be connected to the upper actuator element cross bar 43 so as to be movable in a slot (not shown) in the housing top wall 25. Therefore, the true scope of the invention should be determined not by the details as shown, but rather by the subject matter of the appended claims.

What is claimed is:

1. A dispenser for multiple rolls of flexible sheet material with a housing having a storage chamber and a dispensing chamber interconnected by a roll handling mechanism:

said roll handling mechanism comprising opposed projecting and retractable lugs carried by and slidable within dual longitudinal tracks and including dual upper and lower actuator elements coacting with detent elements and dual drive pins confined within angular slots defining inclined cam surfaces in a base element carrying each said lug;

each said upper actuator element being an elongated component with a medial portion having a transverse notch to captivate a lug base element and permit a "lost motion" projection and retraction movement of a lug, there being above each transverse notch dual elongate slots for receiving and guiding said dual drive pins, the length of said slots being such as to permit a "relative motion" of said upper and lower actuator elements, said upper actuator elements being coupled together for unitary movement by a cross bar, said cross bar carrying an actuating knob;

each said lower actuator element being an elongated component with a medial portion having a transverse notch to receive a lug base element and having a length such as to permit a "relative motion" of a lug during movement of said upper and lower actuator elements, each notch carrying said dual drive pins, said lower actuator elements being coupled together for unitary movement by a cross bar;

said detent elements being carried by a lower actuator element and projecting through an elongate slot in an upper actuator element to engage with detent holes in a longitudinal track.

2. A dispenser according to claim 1, wherein said dispenser housing is formed by rear and front side walls, end walls, a top wall, and a bottom wall, and has a supply opening to the storage chamber and an access opening to the dispensing chamber.

3. A dispenser according to claim 2, wherein said dual longitudinal tracks are attached to the rear and front housing side walls.

4. A dispenser according to claim 2, wherein said dual longitudinal tracks are formed by dual spaced-apart L-shaped rails.

* * * * *